US005941387A

United States Patent [19]

Rasel

[11] Patent Number: 5,941,387

[45] **Date of Patent: *Aug. 24, 1999**

[54] LIGHTPROOF PACKAGE OF PHOTOSENSITIVE STRIP MATERIAL

[75] Inventor: Heinz Rasel, Neu-Isenburg, Germany

[73] Assignee: AGFA-Gevaert, N.V., Mortsel, Belgium

[ * ] Notice: Under 35 U.S.C. 154(b), the term of this patent shall be extended for 564 days.

[21] Appl. No.: 08/579,639

[22] Filed: Dec. 27, 1995

Related U.S. Application Data

[63] Continuation of application No. 08/252,862, Jun. 2, 1994, abandoned.

[30] Foreign Application Priority Data

| | | | |
|---|---|---|---|
| Jun. 5, 1993 | [DE] | Germany | 43 18 790 |
| Nov. 2, 1993 | [DE] | Germany | 43 37 368 |

[51] Int. Cl.[6] ..... B65D 85/67

[52] U.S. Cl. ..... 206/413; 206/415; 206/416

[58] Field of Search ..... 206/316.1, 397, 206/398, 400, 407, 410, 413, 414, 415, 416, 401

[56] References Cited

U.S. PATENT DOCUMENTS

| | | | |
|---|---|---|---|
| 1,260,491 | 3/1918 | Weaver | 206/415 |
| 1,377,154 | 5/1921 | Flynn | 206/415 |
| 2,797,804 | 7/1957 | Pomeroy et al. | 206/413 |
| 3,700,099 | 10/1972 | Heroux | 206/415 |
| 3,895,711 | 7/1975 | Hiltunen et al. | 206/413 |
| 4,015,711 | 4/1977 | Mason | 206/413 |
| 4,148,395 | 4/1979 | Syracuse et al. | 206/414 |
| 4,455,076 | 6/1984 | Birkeland | 354/275 |
| 4,505,387 | 3/1985 | Seto | 206/414 |
| 4,733,777 | 3/1988 | Van Geyte et al. | 206/316 |
| 4,826,008 | 5/1989 | Cloosterman | 206/413 |
| 4,911,299 | 3/1990 | Peeters | 206/410 |
| 5,133,171 | 7/1992 | Chase et al. | 53/409 |
| 5,222,601 | 6/1993 | Takahashi et al. | 206/414 |
| 5,353,933 | 10/1994 | Takahashi et al. | 206/413 |

FOREIGN PATENT DOCUMENTS

| | | |
|---|---|---|
| 0 350 093 | 1/1990 | European Pat. Off. . |
| 0 414 265 | 2/1991 | European Pat. Off. . |
| 0 414 265 A3 | 2/1991 | European Pat. Off. . |
| 0 488 738 | 6/1992 | European Pat. Off. . |
| 0 536 608 | 4/1993 | European Pat. Off. . |
| 0 537 777 A3 | 4/1993 | European Pat. Off. . |
| 2094839 | 2/1972 | France . |
| 93 04 380 U | 6/1993 | Germany . |

*Primary Examiner*—M. D. Patterson
*Attorney, Agent, or Firm*—Breiner & Breiner

[57] ABSTRACT

A lightproof package of photographic strip material, which is wound around a core and forms a hollow-cylinder film roll, its outer circumferential surface enclosed by a cover sheet, its inner circumferential surface enclosed by the core, and its end faces enclosed by thin-walled end caps, so that the packaging does not essentially change the outer dimensions of the existing film roll. The photographic material is not inadvertently exposed when the film roll is partially unwound for use and placed into an operating device under daylight conditions.

16 Claims, 9 Drawing Sheets

45
44
44
46

LIGHTPROOF PACKAGE OF PHOTOSENSITIVE STRIP MATERIAL

This is a continuation of application Ser. No. 08/252,862 filed Jun. 2, 1994, now abandoned.

BACKGROUND OF THE INVENTION

1. Field of the Invention

This invention involves a package for photosensitive strip material, particularly film. These packages ensure the serviceability of the photosensitive material until it is used. They protect the film from inadvertent exposure and humidity.

2. Description of Related Art

A useful form of package is the so-called wound roll, which has the film wound around a core and protected from light by a cover sheet and two end pieces. The so-called daylight package, which permits a film change in daylight, has been successfully introduced into the market. The roll is generally held on two receptor lugs of an operating device. The cover sheet is partially unwound and fed through a lightproof slit. The cover of the receptor housing is then closed. The receptor can be a fixed component of the device or a cassette. A further tug on the cover sheet makes the film emerge from the slit. In most cases, the cover sheet is now separated from the film and discarded. The forwarding mechanism grips the beginning of the film and transports the film into the exposure chamber of the device. The device is ready for operation. Changing the film does not require a darkroom.

A daylight package of roll film is disclosed, for example, in U.S. Pat. No. 4,148,395. It comprises essentially a cover sheet and two disk-shaped end pieces. It has peripheral, flap-shaped sections that are folded over and adhere on the circumferential surface of the cylinder. Inside, the end pieces adhere on the end faces of the core. However, it has been shown that this package is not lightproof under certain conditions. One problem is that the fold-over produces irregular folds with open spaces and resulting exposure of the outer area of the film roll. Frequently, the adhesion area on the end faces of the core is inadequate as a result of slight mechanical stresses. This results in inadvertent exposure of the film inside the roll.

U.S. Pat. No. 4,505,387 discloses similarly a daylight package for film rolls, in which package a cover sheet wider than the film strip has incisions and is partially folded around the end faces. Here, too, the inner area of the end pieces adheres to the end face of the core and can result in unintentional exposure of the film. In addition, the folds increase the axial measurement of the roll, which is often undesirable.

EP 0,350,093 describes a lightproof package for strip film with a packaging sheet enveloping both the outer circumferential surface and the end faces of a film roll. The overhanging edges are tucked into the core and sealed there in a lightproof manner. The latter step makes this package expensive and can damage the thermosensitive photographic material if a heat-sealing tool is used.

In EP 0,414,265, the parts of the cover sheet extending beyond the width of the film are tucked into the core and held by fasteners. The fasteners and the irregular folds in the cover sheet change substantially the outer dimensions of the roll with respect to certain operating devices and film formats.

EP 0,488,738, EP 0,536,608, and U.S. Pat. No. 4,455,076 disclose packages with rigid flanged disks forming the end faces and with the cover sheet forming a lightproof bead enclosing the periphery. These flanged disks are indeed additional protection against mechanical damage, but they increase the axial length of the film roll.

U.S. Pat. No. 4,826,008 discloses a packaging for film rolls comprising a rigid tube and two end caps inserted into the tube and the roll core. The axial length and the outer diameter of the film roll are increased considerably by the packaging.

Increasing the dimensions of the film roll by the packaging is often not acceptable in the use of the film. The axial spacing of the receptor lugs is indeed adjustable so that narrower film formats can be used, but this spacing is always limited for the largest film formats. The axial length of the film roll frequently exceeds slightly the available inner diameter of the housing. Thus, the film cannot be used in this device because of the packaging. The tolerances for the package measurements can be very narrow. In many instances, a film roll from one manufacturer can fit into an operating device once, but, possibly at another time, cannot be loaded into the same type of apparatus. The standard tolerance ranges for the film manufacturer and the manufacturer of the operating device are indeed observed, but do overlap. Frequently, only fractions of a millimeter decide the serviceability of the film roll.

The film manufacturer strives to size the film roll so that it fits the greatest number of operating units from different companies. In other words, the film manufacturer must adapt its film to the receptor device provided by the unit's manufacturer. This means that the packaging must be shaped so that the dimensions of the film roll, particularly its axial length and the inner diameter of the core, hardly vary. Furthermore, the individual components of a film roll should be as standardized as possible, so that they can be easily processed automatically by packaging machines. Furthermore, after the film is used, the packaging should be easily separable into its different materials for recycling.

SUMMARY OF THE INVENTION

The invention is based on the problem of providing a package for photosensitive strip material, a package that does not change essentially the axial length and the inner diameter of the film roll.

This problem is solved in the present invention. The invention makes possible a space-saving package that protects the photosensitive film reliably until it is used. Furthermore, the packaging step can be automated. The package can be prepared inexpensively compared to the current state of the art. The lightproof closure of the edge joint of the outer circumferential surface is achieved essentially by an elastic, opaque sealing disk that is part of the end cap and interacts with the cover sheet. Each end cap has a horizontal inner and outer radial extension. The outer extension forms a sleeve for the film roll and presses the periphery of the sealing disk against the end face of the film roll so that the edge of the sealing disk curves around the end face and seals it in a lightproof manner. The inner surface of this sleeve is coated with an adhesive and adheres to the cover sheet.

The inner extension of the end cap is hub-shaped, projects into the core and forms a lightproof closure. Adhesive is not required for a lightproof seal at this site. This is a decisive advantage. There is no need here for an expensive metering device to apply the adhesive accurately without contaminating the film. It is also an advantage that the attachment is maintained by friction and can be released manually. If, for example, the end cap and the core are made of different materials, they can be separated easily for recycling.

These types of end caps significantly simplify making a lightproof roll. The end caps can be prepared beforehand. As the end cap extensions are conical, the end caps can be mounted simply by insertion into the film roll. A pressure fit joins the inner extension of each end cap to the film roll. The adhesive inner surface of the outer extension adheres to the cover sheet after a pressure step.

The preferred end caps are made of synthetic resin, for example, by deep drawing. The axial length of the film roll is increased by only a fraction of a millimeter by this packaging. The end caps can also be a compression-molded part of paper or cardboard.

A preferred form of the end cap is composed of three sections. A disk-shaped flexible section presses the sealing disk against the end face of the film roll to make a lightproof closure. The flexible section has incisions on the periphery. Curving this area down produces a circumferential zone that generates a sleeve firmly attached to the cover sheet of the film roll. The inner area of the flexible section facing the core adheres to a hub-shaped section projecting into the core. This structure achieves an even greater space-saving package. In the inner area where a specific degree of shape retention is required for the friction fit with the core, the hub-shaped section of the end cap has a somewhat thicker wall. A flexible thin material is used for the end face and the peripheral area of the end cap, which involve primarily a lightproof casing. In comparison, the cover sheet is more tear-resistant. The different tear resistance of these sections facilitates simple construction of the daylight package.

To fix the hub-shaped section in place, it is advantageous to have it in two segments. The first segment, a sleeve-shaped extension, forms a reliable and lightproof connection with the core. If the core is cardboard, it is advantageous to have the outer diameter of the sleeve-shaped extension 0.3 mm to 0.5 mm larger than the inner diameter of the core. This also creates a secure fit if the inner diameter of the core fluctuates, for example, as a result of manufacturing tolerances or variable humidity. The second segment of the hub-shaped section is tapered. This eases insertion into the core. An axial length of about 35 mm has proven to be desirable for the hub-shaped section for all film formats.

Sealing disks of opaque, easily flexible material are preferred, with an outer diameter greater than the outer diameter of the film roll. If, in mounting the end cap, it is pressed against the end face of the film roll, the overhanging area of the sealing disk curves over the outer edge of the circumferential surface. This creates a lightproof closure. The sealing disk also prevents contamination of the film by adhesive. An advantageous sealing disk is made of a black, pigmented, elastic sheet 0.05 mm to 0.2 mm thick, 0.1 mm thick being especially preferred.

It is advantageous to have the sealing disk overhang the film roll by 0.7 mm to 2 mm. Thus, folds do not form in the region of curvature.

The length of the cover sheet is preferably about 1.5 times the circumference of the film roll and encloses its outer circumferential surface. The end of the cover sheet adheres to and is centered on the film strip. The leader of the cover sheet is attached to the outer circumferential surface of the film roll, for example, by adhesive strips. The lightproof quality of the package is improved by a cover sheet wider than the film strip.

A cover sheet 0.4 mm to 0.5 mm wider than the film is preferred. During assembly, not only does it bevel the periphery of the sealing disk around the outer cylinder edge, but the edge of the cover sheet also curves over the end face free of folds. The overlap creates a light labyrinth. The lightproof characteristics of the package are determined substantially by this overlap. The flexible section is indeed curved around the cylinder edge, but serves primarily to mechanically join the end cap to the film roll.

It is an advantage to have the perimeter of the flexible section consist of flap-shaped segments. These can be formed without folds and can be curved around and fastened on the outer circumferential surface without creating dome-shaped cavities. The flap-shaped segments are made by incisions on the periphery.

It is advantageous to have the incisions made not radially but rather on secants; when curved over, they run essentially axially. The peripheral area of the flexible section becomes saw-toothed. It is also advantageous if the incisions oriented one upon the other are not equally long and do not cross. Curving down the saw-toothed edge then yields overlapping areas.

The long incisions can now terminate on a circular diameter that is either larger or smaller than the outer diameter of the film roll. A difference in these diameters of about 10% has been shown to be advantageous in practice with film rolls having an outer diameter between 80 mm and 150 mm. In the first instance, in which the circular diameter is larger than the outer diameter of the film roll, very good packaging properties are obtained, because the lightproof seal between the overhanging areas of the sealing disk and the circumferential surface is additionally covered by the flexible section.

It has been found, surprisingly, that the package in the second cited instance is also reliably lightproof, if the incisions along the secants extend over the lightproof seal onto the end faces of the cylinder. Furthermore, this does not create cavities or folds. This package example is especially advantageous if a large number of pieces is to be fabricated and the costs of the packaging equipment are to be kept low. A simple pressure tool suffices to uniformly shape the overlap of the flap-shaped segments. Adjacent flap-shaped segments overlap in the same direction. As a result, the force applied to open the package is symmetrical.

It is advantageous to have the cover sheet leader taper asymmetrically, for example, in two segments running at different oblique angles. This evens out the pull force required for a daylight package, because the flap-shaped segments of first one end cap and then those of the other end cap are pulled off. The shape of the cover sheet taper is unimportant. It is critical that both tapers are offset lengthwise with respect to each other by three or four times the width of a flap-shaped segment.

The end of the cover sheet is joined to and overlaps the beginning of the film. The cover sheet is adhered preferably to the surface of the photosensitive material facing the film roll. This simplifies the withdrawal of the attachment site through the slit of the operating device by counteracting the ever present tendency of the film to rewind in response to the curvature of the film roll.

The hub-shaped section is advantageously made of black pigmented polyethylene. This material yields elastically, permits economical and accurately sized production, and can be recycled. With a polyethylene thickness of 0.3 mm, the film roll fits all of the operating devices currently in the market. The contact surface to the receptor lug is flat, and inserting the film roll is easy. Variable roll core tolerances are accommodated by the elastic material.

The preferred conical surface terminates with a rounded edge. The receptor lugs in many operating devices are connected by a spindle. Whenever this spindle is passed through the core during the loading of the film roll, an end cap may inadvertently be loosened. The rounding deflects the spindle from the end cap. Furthermore, the rounding increases the section modulus of the hub-shaped section, an advantage in automatic handling.

It is advantageous to have the flexible section made of paper. At a thickness of 0.5 mm to 0.3 mm, particularly at 0.1 mm, only a very low pull force of about 5 N is required without friction in the slit.

It is also advantageous to have the flexible section made of an opaque, flame-treated, polyethylene sheet 0.05 mm to 0.2 mm thick. A thickness of 0.08 mm is particularly advantageous. The flame treatment embrittles the material and surprisingly, the tear spreads uniformly along the periphery. This material can be recycled.

A black polyethylene sheet 0.05 mm to 0.2 mm thick, preferably 0.1 mm thick is desirable for the sealing disk. The elasticity of the disk permits it to fit the contour of the cylinder edge without folds.

The cover sheet is preferably a polyethylene sheet, 0.1 mm to 0.3 mm thick, 0.2 mm thickness being especially preferred. This assures that the tear in the thin end caps spreads as the film is unrolled. Furthermore, it has been shown that the thickness of the cover sheet confers advantages in making the package. Pressing the flap-shaped segments can cause the so-called pressure sensitization. The cover sheet yields elastically and diminishes this undesirable damage to the film.

From the standpoint of recycling, packaging of homogeneous material, for example polyethylene, is advantageous.

In a special example of the invention, each end cap has perforations in the peripheral area. This aid for opening the package decreases the pull force to unroll the film, namely, opening the package. Furthermore, this assures that the tear formation runs along a predetermined, defined tear line. The perforations are particularly advantageous if the flexible section comprises a conventional, opaque, polyethylene sheet. The perforations do not degrade the lightproof characteristics of the package. The perforations are advantageously located in a circle with a diameter about equal to or 10% smaller than the outer diameter of the sealing disk. The perforations can be made as the so-called slits or holes. Perforation slits of equidistant incisions of about 0.7 mm yield very good tear results.

Various methods of making the perforations are known in the art. For example, the flexible section and the perforations can be made in one step with a rotary cutting tool.

A simple and economical embodiment of the package is obtained if each end face of the film roll is covered by a sealing disk and an end cap of paper or cardboard. Assembly is especially easy if the hub-shaped section and the circular area forming the sleeve for each end cap are prefabricated.

The hub-shaped section is simply inserted into the core and held there by friction. The circular area, which forms a sleeve for the axial edge of the film roll and has an adhesive layer on the inner surface facing the circumferential surface, is pressed onto the outer circumferential surface of the film roll. Paper or cardboard end caps, 0.1 mm to 0.3 mm thick, are preferred for this embodiment.

Perforations in the peripheral area of each end cap simplify opening the package. These reduce the pull force required to unroll the film.

The synthetic resin sealing disk does not adhere to the paper or cardboard. It can be separated easily for recycling.

The use of primarily only one material, for example, synthetic resin, is especially advantageous, thus completely eliminating a separation process.

The invention involves a method for the lightproof packaging of a film roll. Essentially, prefabricated end caps are inserted into the film roll and curved over the edge. It is advantageous to apply tangential stress to curve the flap-shaped segments downward. This is done so that the flexible section presses the sealing disk against the end face of the film roll to form a lightproof closure. A suitable tool has a divided, tube-shaped pressure section with inner beveled surfaces. It curves the flap-shaped segments down without creating light channels. The resulting overlapping areas contribute to increasing the lightproof characteristic. Dome-shaped cavities do not occur.

BRIEF DESCRIPTION OF THE DRAWINGS

The invention is described in more detail in the following with the aid of an example and related drawings described as follows.

DESCRIPTION OF THE PREFERRED EMBODIMENT

Figures 1A, 1B:
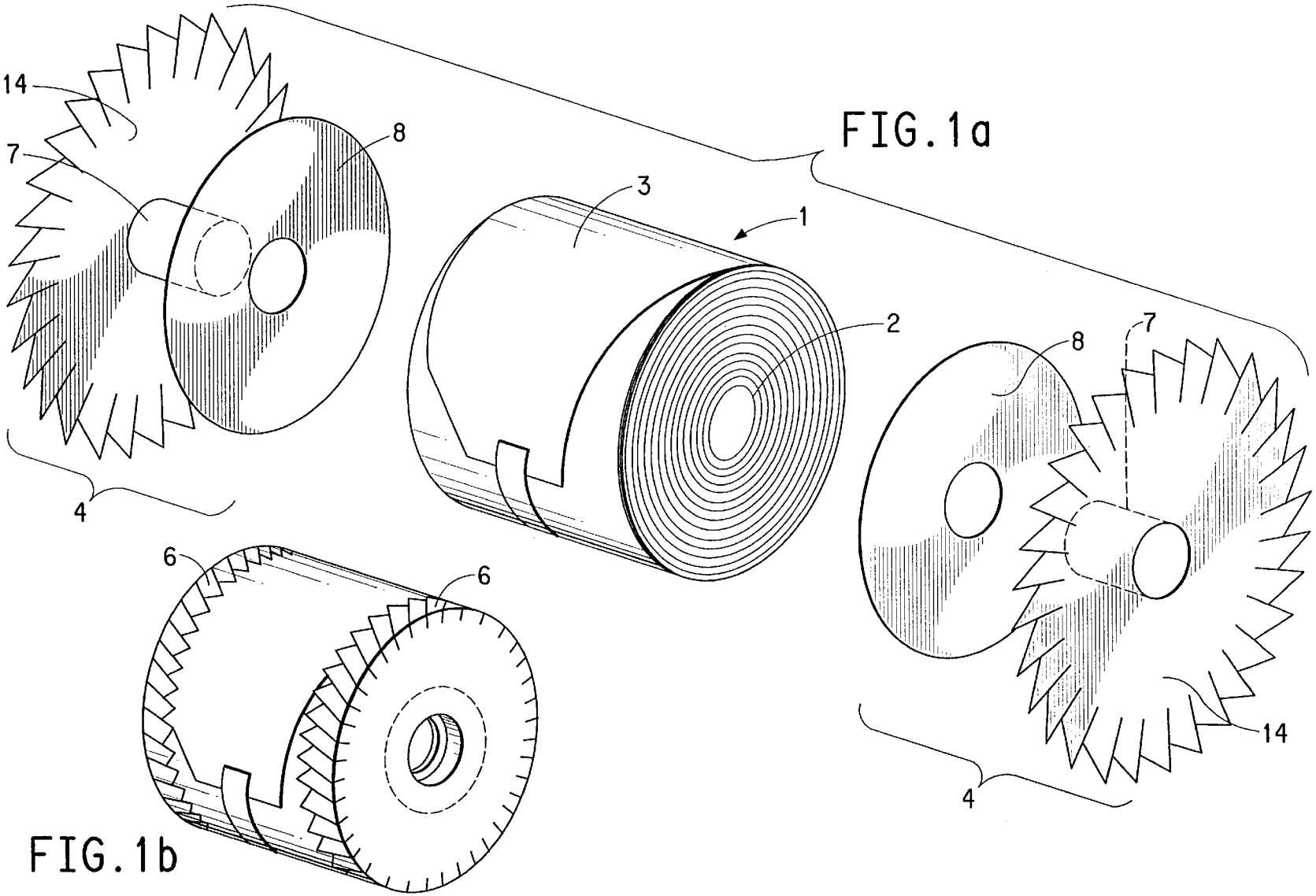
FIGS. 1*a* and *b* are an exploded perspective and a non-exploded perspective view of an embodiment of the package, respectively.

Throughout the following detailed description, similar reference characters refer to similar elements in all figures of the drawings.

FIGS. 1*a* and *b* show a preferred example of a lightproof package. Circumferential surfaces of a cylindrical, hollow core, film roll 1 are bounded by a cover sheet 3 and core 2. Each end face is covered by an end cap or cover element 4, which comprises a sealing disk 8, a flexible section 14, and a hub-shaped section 7. A peripheral area 6 forms a sleeve for an axial edge 9 of the film roll 1.

Figure 2:
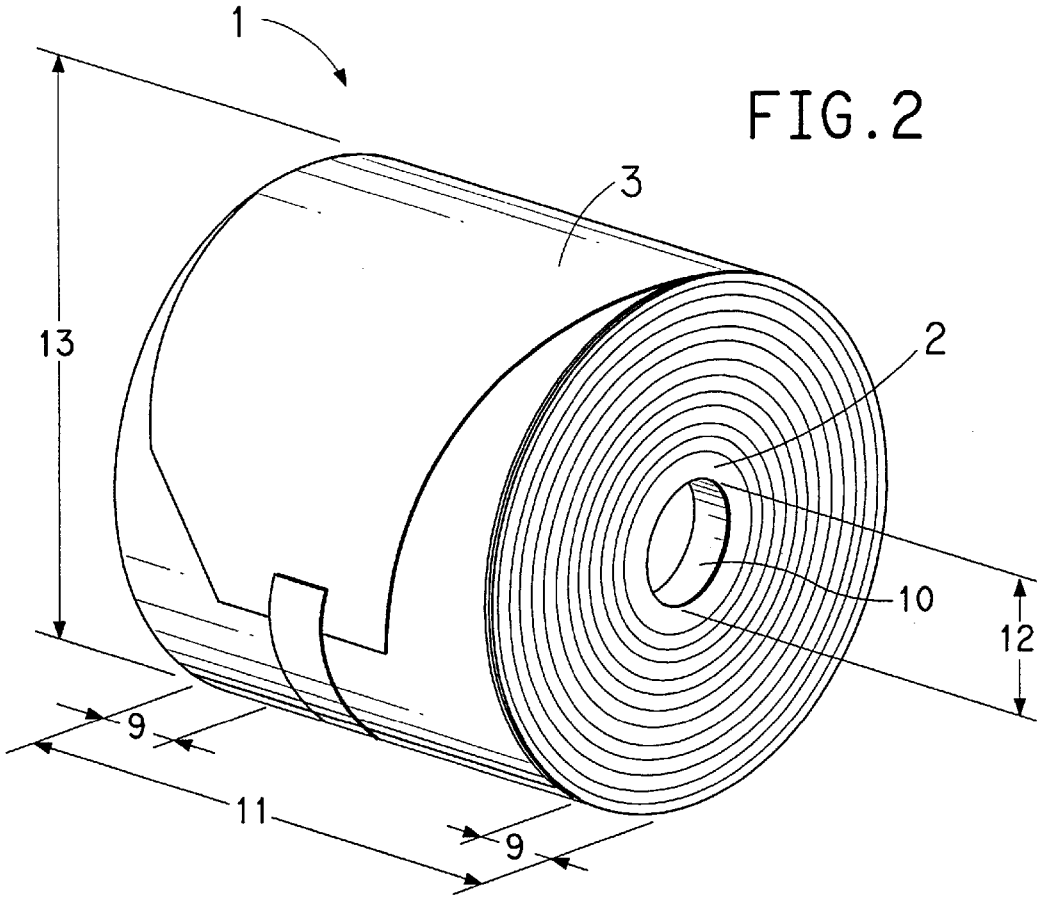
FIG. 2 is a spatial view of a film roll.

FIG. 2 shows an enlarged view of film roll 1. The axial edge 9 of the outer circumferential surface and an axial edge 10 of an inner circumferential surface form contact surfaces for each end cap 4. An outer diameter 13 of the film roll 1 is determined by an outermost wrap of the cover sheet 3. An inner diameter 12 of the film roll 1 is, in this instance, the inner diameter of the core 2. The photosensitive material is wound spirally on the core 2 to form a hollow cylinder with essentially flat end faces, and the axial length 11 of the film roll 1 corresponds to the length of the cylinder.

Figure 3:
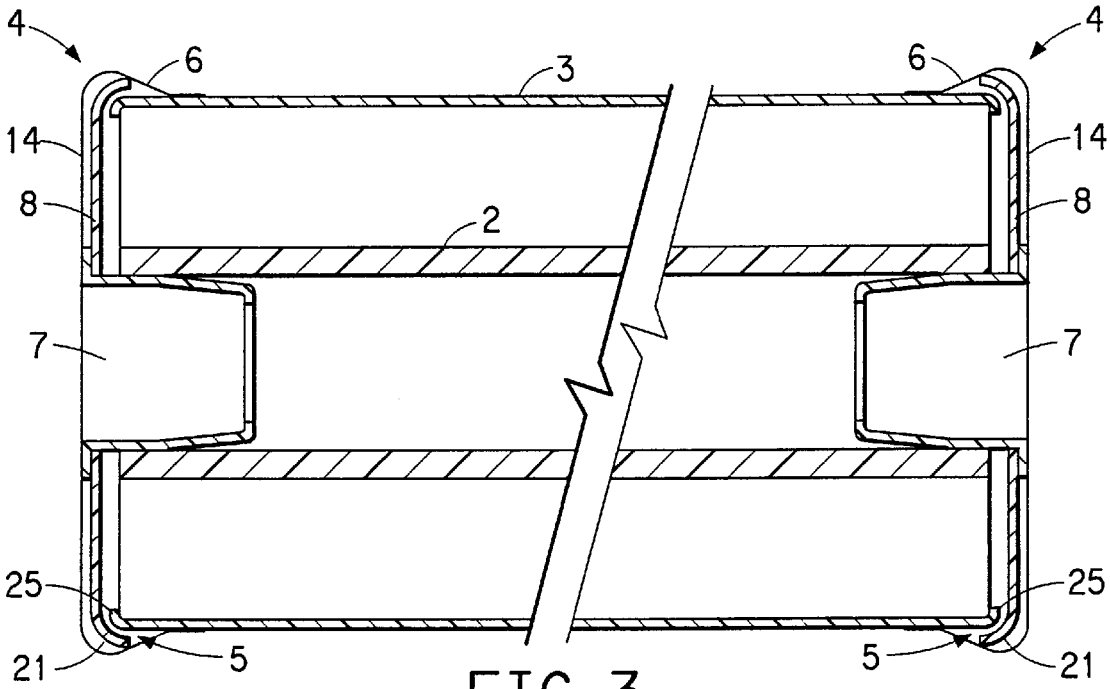
FIG. 3 is a cross-section view of a film roll.

FIG. 3 shows a cross-section through a preferred example of the package with intermediate spaces being highly exaggerated. The package is constructed symmetrically. Each end face is covered by an end cap 4. The hub-shaped section 7 projects into the core 2 and is joined to a flexible section 14. The peripheral area 6 of the end cap 4 lies on the outer circumferential surface of the film roll 1. One edge 25 of the cover sheet 3 is curved over an end face of the film roll 1. An edge 21 of the sealing disk 8 is curved over the outermost axial edge of the outer circumferential surface of the film roll 1. Edges 21 and 25 produce an overlapping edge joint that forms a lightproof labyrinth 5.

Figure 4:
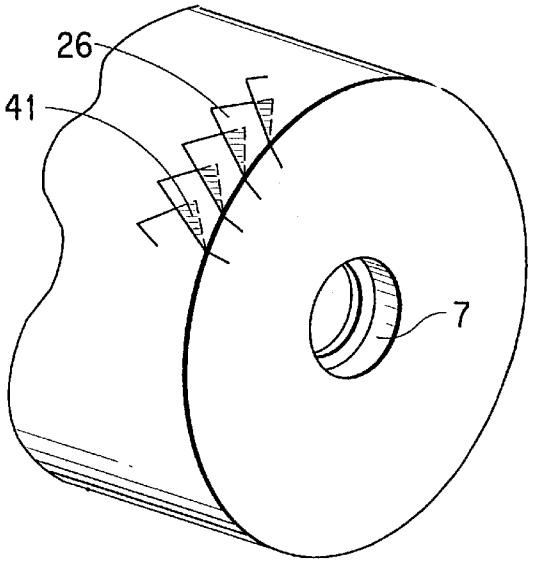
FIG. 4 is a partial view of an end face of the film roll with folded-over flap-shaped segments.

FIG. 4 shows an enlarged three-dimensional view of flap-shaped segments 26 and their overlap 41. This sawtooth configuration of the peripheral area 6 is a preferred embodiment of the end cap 4. The flap-shaped segments 26 overlap with regularity. In the folded-over state, the right or left flap is above or below, respectively. Although a fold line of the flexible section 14 is a curvilinear cylinder edge, the fold-over does not create cavities. The flap-shaped segments 26 are adhered to the cover sheet 3. The hub-shaped section 7 projects into the core 2, held in place by friction.

Figure 5:
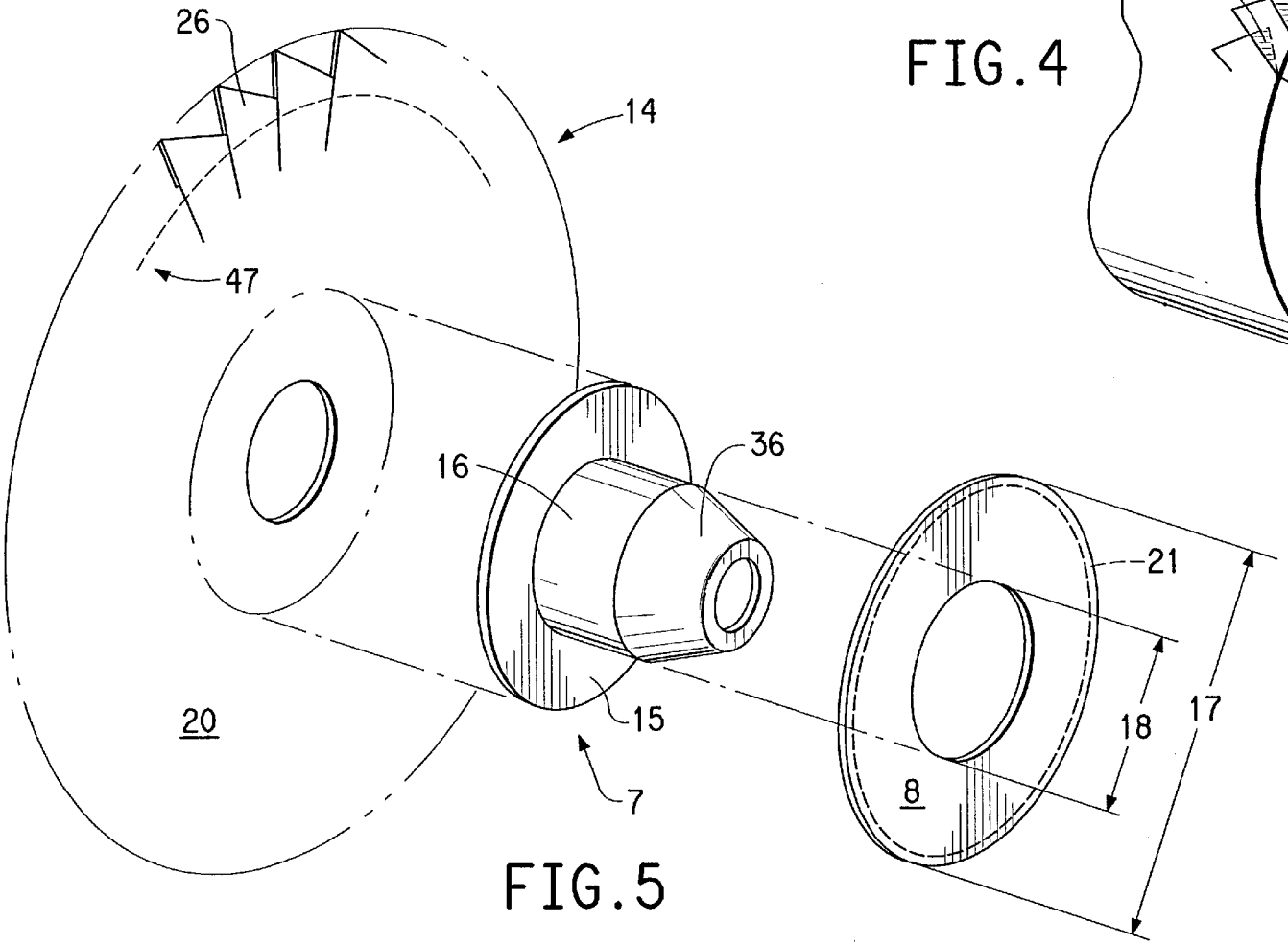
FIG. 5 is an exploded view of an example of an end cap.

FIG. 5 shows an exploded view of a preferred embodiment of the end cap 4. A flange-shaped extension 15 of the hub-shaped section 7 is attached to the flexible section 14 by an adhesive layer 20. A periphery of the flexible section 14 is partially illustrated and shows schematically flap-shaped segments 26 that are not folded over and perforations 47. The sealing disk 8 fits on a sleeve-shaped extension 16 of the hub-shaped section 7. An inner diameter 18 of the sealing disk 8 is slightly larger than an outer diameter of a cylindrical sleeve-shaped extension 16. The latter acts as a centering device in the preassembly of the sealing disk 8. An outer diameter 17 of the sealing disk 8 is larger than the outer diameter 13 of the film roll 1. This assures that the edge 21 overhangs uniformly along the periphery of the film roll 1 before the flap-shaped segments 26 are curved down. The sleeve-shaped extension 16 terminates in a conical surface 36.

Figure 6:
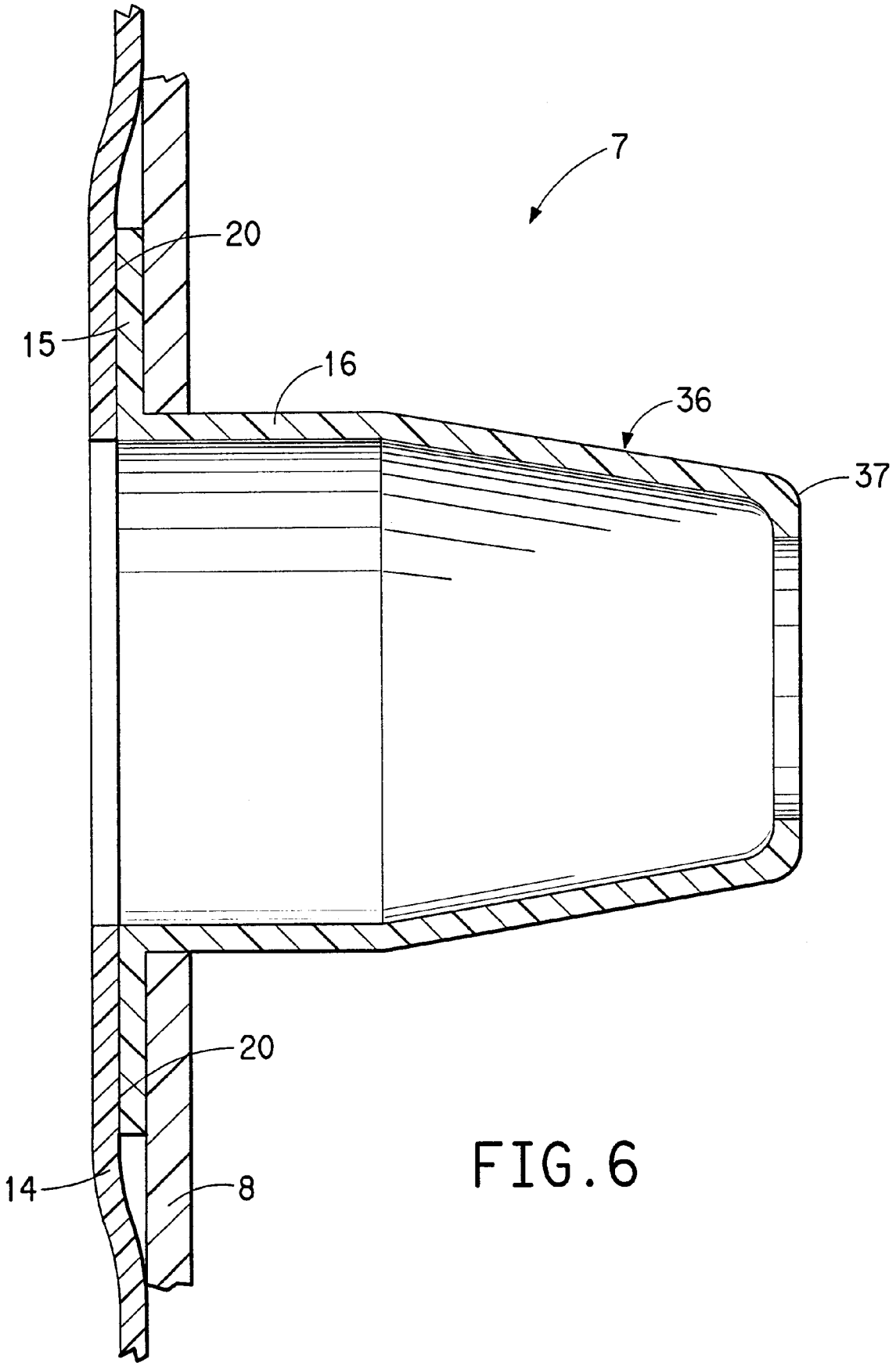
FIG. 6 is a detailed view of a cross-section of the hub-shaped section on the inner area of the end cap.

FIG. 6 shows how the individual sections of the end cap 4 are connected. The flexible section 14 is adhered to the face of the flange-shaped extension 15. The adhesive layer 20 is located on an inner lateral surface of the flexible section 14. The sealing disk 8 is also adhered on this surface. This type of preassembled end cap 4, which already has the flap-shaped segments 26 in its peripheral area 6, simplifies significantly a subsequent assembly step. The two end caps 4 can be pressed simultaneously onto the film roll 1, so that the end faces can be sealed essentially in one step. The conical surface 36 simplifies insertion of the end caps 4. The sleeve-shaped extension 16 assures that the friction connection is maintained even during jostling in shipment. A rounded edge 37 is useful during a film change. It prevents damage to the package during insertion of the end caps 4. Wall thickness of the hub-shaped section 7 can also vary cross-sectionwise. For example, the flange-shaped extension 15 can have a thin wall. A polyethylene flange-shaped extension 15, 0.1 to 0.2 mm thick, has been shown to be desirable. The hub-shaped section 7 eliminates the need for sealing or the application of adhesive in the core 2.

Figure 7:
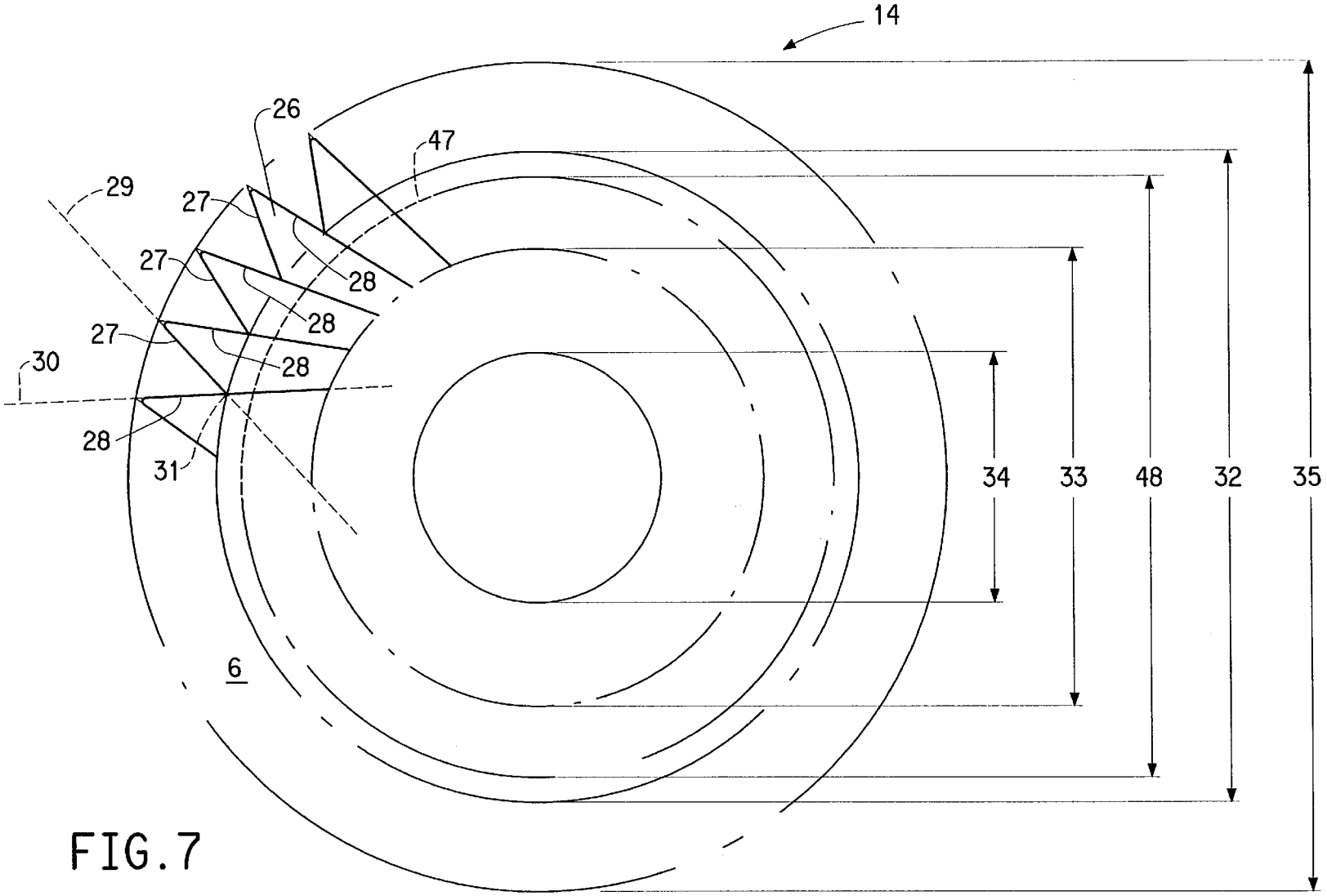
FIG. 7 is a view of the flexible section of the end cap.

FIG. 7 shows a view of the flexible section 14 of an especially preferred version of the end cap 4. An outer diameter 35 of the flexible section 14 is large enough to make adequately sized flap-shaped segments 26. The flap-shaped segments 26 are formed by incisions of different lengths on secants 29, 30 in the peripheral area 6. Long incisions 28 terminate on a circular diameter 33 that is smaller (or shorter) than the outer diameter 13 of the film roll 1. Short incisions 27 terminate on a circle 32 through intersection points 31 of the secants 29 and 20. The perforations 47 are uniform incisions on a circle 48. An inner diameter 34 of the flexible section 14 is selected so that the flexible section 14 can be center-mounted on the hub-shaped section 7. Tips of the flap-shaped segments 26 can be rounded, as shown in FIG. 7, which can be accomplished, for example, by stamping or rotary cutting during manufacture of the flexible section 14. This rounding assures easier ejection from the stamping or cutting tool.

Figure 8:
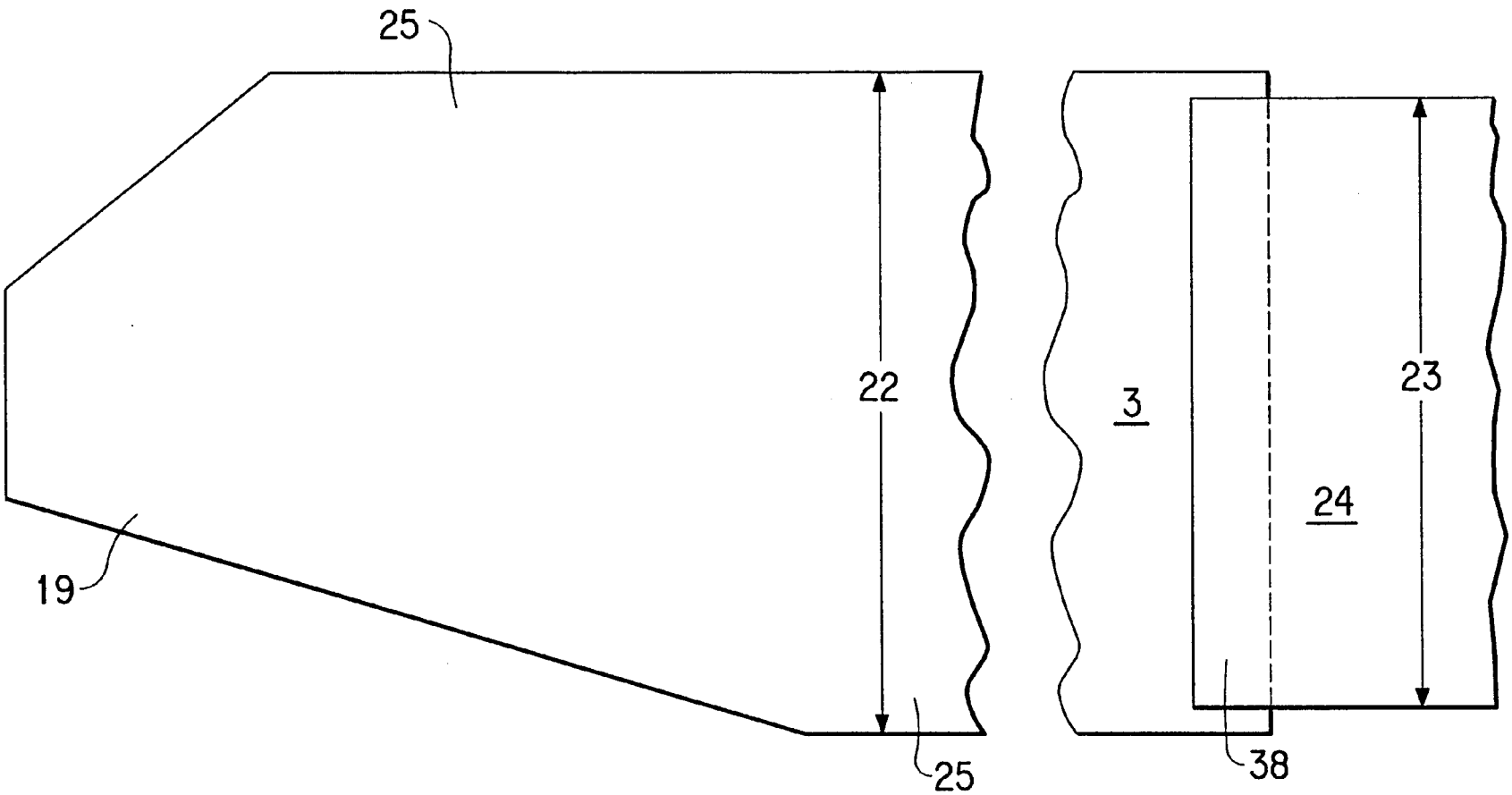
FIG. 8 is a schematic drawing of the attachment of the cover sheet to the film.

FIG. 8 shows schematically the attachment of the cover sheet 3 to photosensitive material 24, viewed on the unwound outer circumferential surface. As width 22 of the cover sheet 3 is larger than width 23 of the photosensitive material 24, there is an overhanging edge 25 on both sides of the cover sheet 3. A flap-shaped leader 19 of the cover sheet 3 is formed by edge cuts offset at different diagonal angles with respect to a longitudinal axis of the photosensitive material 24. FIG. 8 shows a strip of the photosensitive material 24 lying on and adhered to the cover sheet 3 by adhesive in an overlapping adhesive area 38.

Figure 9A:
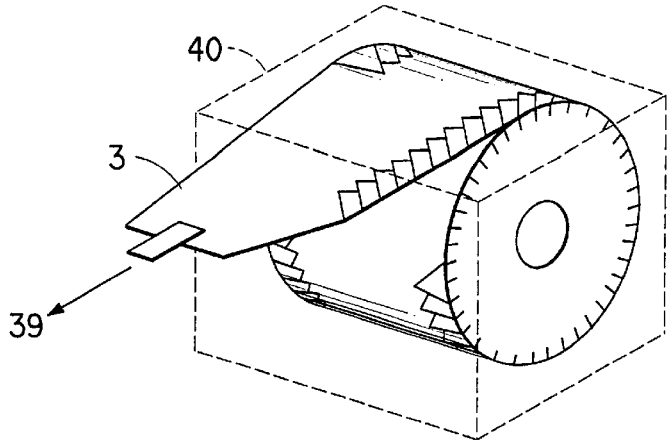
FIGS. 9*a* to *c* show a schematic drawing of a daylight package of roll film being unwound.
Figure 9B:
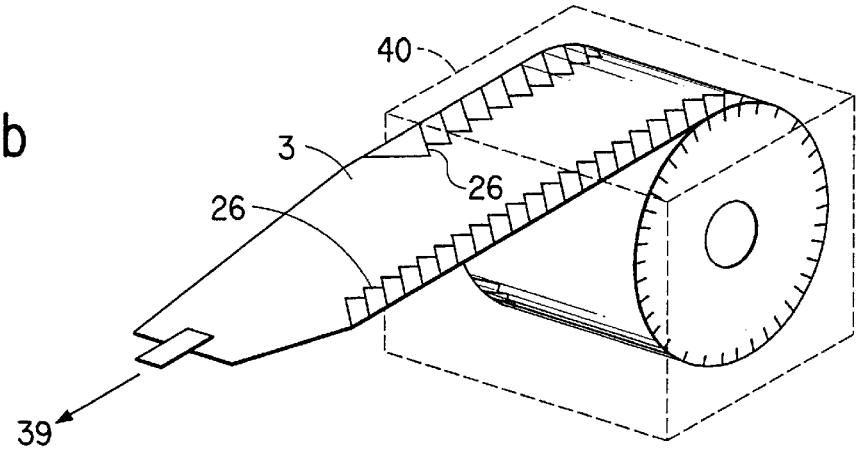
Figure 9C:
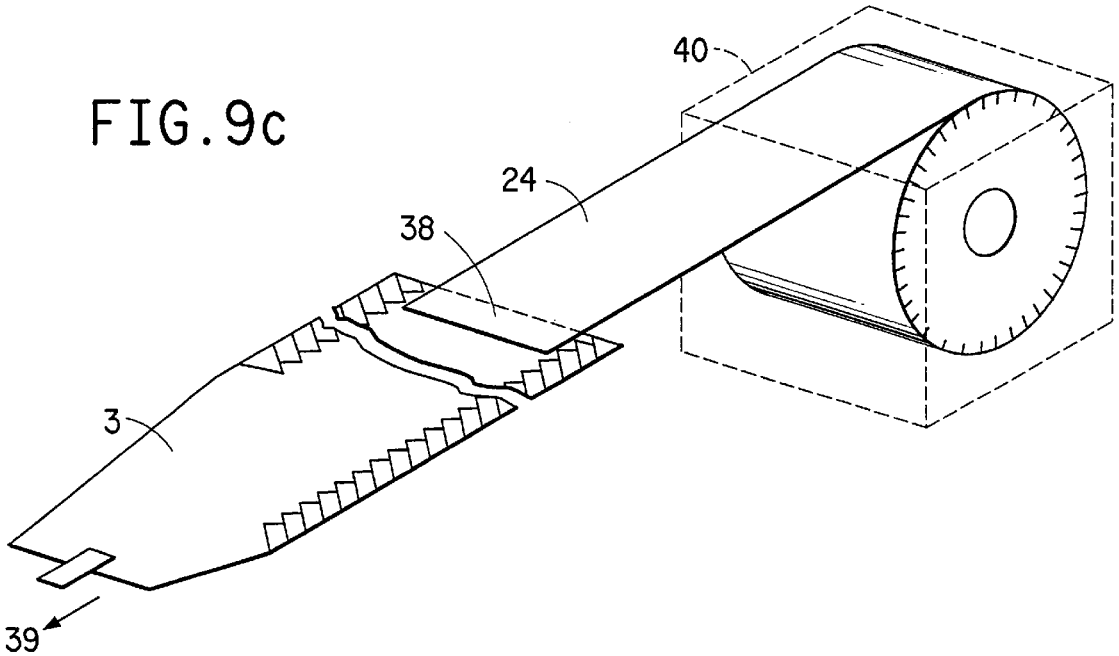

FIGS. 9*a–c* show schematically a daylight package being unwound. Force 39 acting in the direction of the arrow in FIG. 9*a* pulls the flap-shaped leader 19 of the cover sheet 3 through a lightproof slit of a housing 40, shown by dashes. This pull force 39 is determined by the friction of the cover sheet 3 in the slit until the pull force 39 acts on the first flap-shaped segment 26 of an end cap 4. The force 39 is increased until these flap-shaped segments 26 break. Then, the force 39 decreases to a value determined by the required breaking force along this end cap 4 and by the frictional resistance in the slit. The required pull force 39 increases again when the flap-shaped segments 26 on the other end cap 4 break (FIG. 9*b*). Then, the force 39 drops to a value equal to about twice the breaking force for an end cap 4 and the frictional resistance in the slit until the end caps 4 are separated from the circular periphery and the photosensitive material 24 emerges from the slit (FIG. 9*c*). The adhesive area 38 is pulled loose, and the cover sheet 3 is separated from the film.

Figure 10:
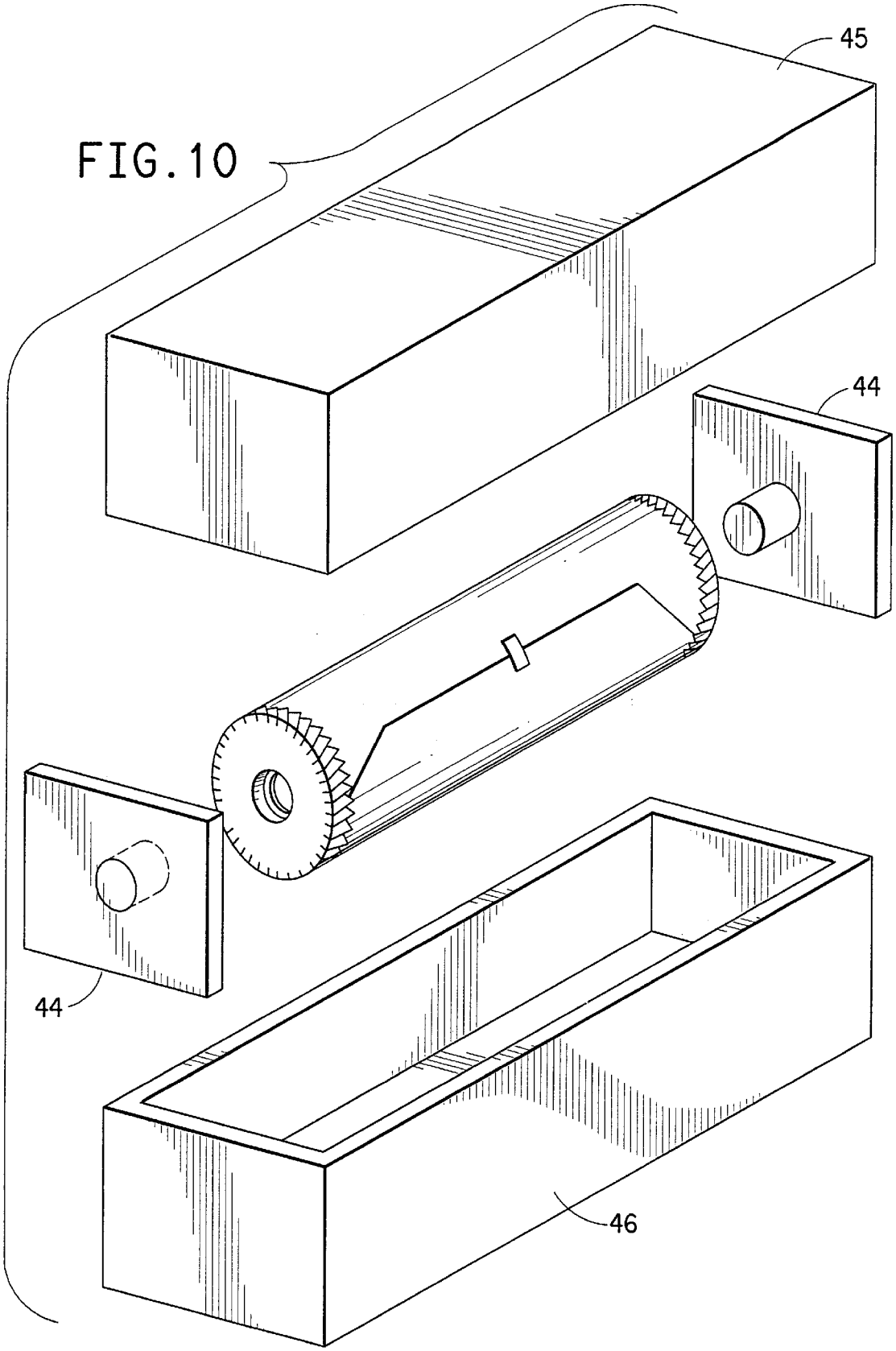
FIG. 10 is a shipping container for a film roll.

FIG. 10 shows a shipping container for film rolls. Each end of the film roll 1 rests in a support 44. The support 44 fits tightly in the box 45 with a cover 46. The film is thus protected against mechanical damage. Flanged end disks used currently are not needed for this packaging.

Figure 11:
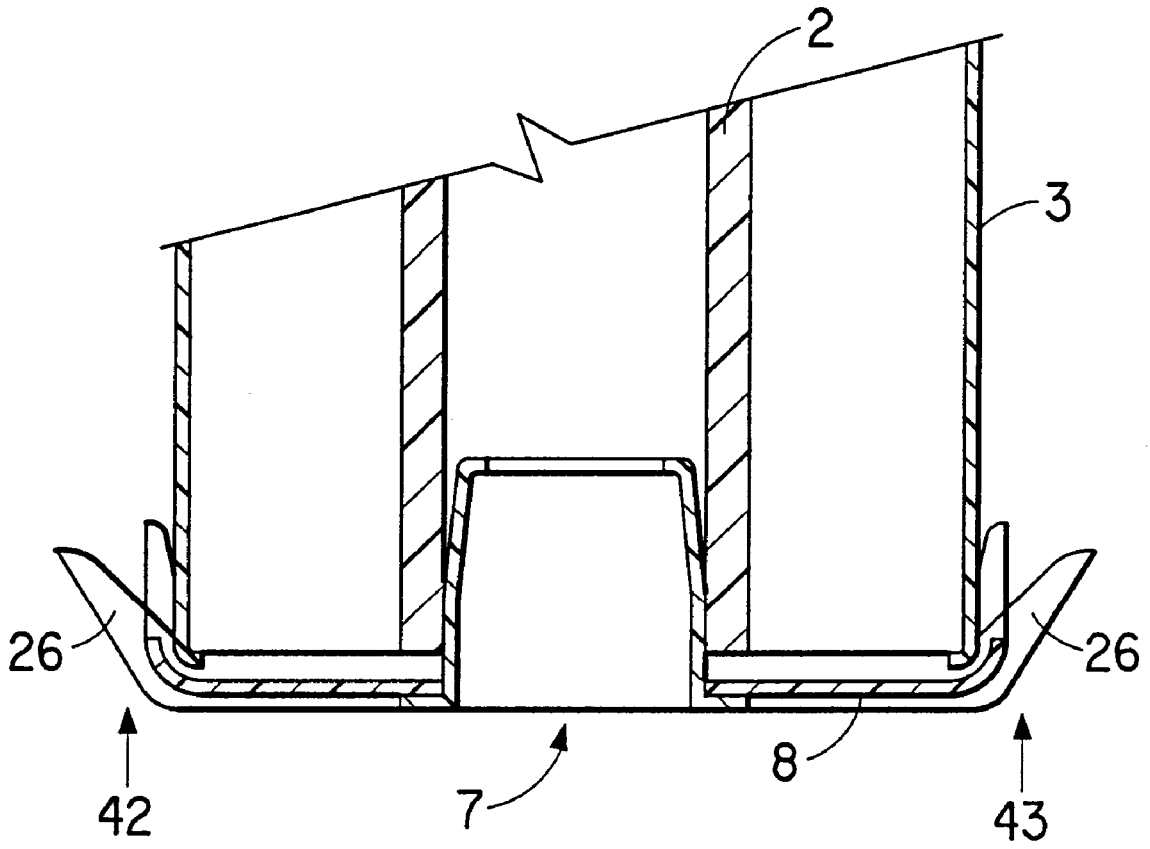
FIG. 11 is a schematic drawing of the packaging step.

FIG. 11 sketches schematically a packaging step. The hub-shaped section 7 of the end cap 4 is inserted into the core 2. A pressure tool, not shown, is moved in the direction of the arrows 42, 43 exerting tangential pressure on the flap-shaped segments 26. The tool also presses in a radial direction by means of a bevel surface, not shown, so that the sealing disk 8 comes firmly into position with the end face and the flap-shaped segments 26 come firmly into position with the cover sheet 3.

What is claimed is:

1. Packaging for a strip of photosensitive material, comprising:

a cylindrical core having a core outer circumferential surface, a longitudinal axis and a core inner cylindrical surface defining a passage extending along the longitudinal axis through the core, the core inner cylindrical surface having inner axial edge portions, the core for receiving the strip of photosensitive material wound spirally on the core outer circumferential surface forming a roll of the photosensitive material having essentially flat end faces, a roll outer circumferential surface and an axial length predetermined essentially by a width of the strip;

a cover sheet for attaching to an end portion of the strip, for being wound on the roll outer circumferential surface, and having outer axial edge portions, overhanging edge portions attached to the outer axial edge portions, the overhanging edge portions extending beyond the width of the strip and adapted to be deflected along a curved path towards the essentially flat end faces; and opaque end caps each comprising a flexible section, a sealing disk, and hub-shaped section for covering the inner axial edge portions, the essentially flat end faces, the overhanging edge portions and the outer axial edge portions.

2. The packaging for a strip of photosensitive material according to claim 1, characterized in that:

the flexible section extends at least between the cover sheet and the core and has a peripheral area that forms a sleeve which is attached to one of the outer axial edge portions of the cover sheet;

the sealing disk is located between the flexible section and one of the end faces such that the sealing disk is not attached to the roll; and the hub-shaped section can be inserted with a friction fit into the passage to cover one of the inner axial edge portions.

3. The packaging for a strip of photosensitive material according to claim 2, characterized in that:

each of the sleeves having an inner surface facing one of the outer axial edge portions;

first adhesive layers adhering the peripheral areas to the cover sheet; and second adhesive layers adhering inner edges of the flexible sections to the hub-shaped sections.

4. The packaging for a strip of photosensitive material according to claim 3, characterized in that each of the hub-shaped sections has a sleeve-shaped extension for contacting the inner circumferencial surface in a friction fit and lightproof manner and a conical surface to simplify inserting the hub-shaped section into the passage.

5. The packaging for a strip of photosensitive material according to claim 4, characterized in that outer diameters of the sleeve-shaped extensions are larger than a diameter of the passage.

6. The packaging for a strip of photosensitive material according to claim 4, characterized in that the conical surfaces of the hub-shaped sections project into the passage and terminate in rounded edges.

7. The packaging for a strip of photosensitive material according to claim 3, characterized in that an outer diameter of the sealing disk is larger than an outer diameter of the cover sheet.

8. The packaging for a strip of photosensitive material according to claim 3, characterized in that the peripheral areas comprise flap-shaped segments that are formed by short and long incisions starting on peripheries of the flexible sections, the short incisions terminating just before an outer diameter of the cover sheet and in that the flap-shaped segments are adhered by the first adhesive layers to the cover sheet so that the flap-shaped segments lie on the outer axial edge portions of the cover sheet.

9. The packaging for a strip of photosensitive material according to claim 8, characterized in that each of the flap-shaped segments is formed by two different length incisions lying on secants that meet but do not cross over each other, whereby the flap-shaped segments, when curved down, overlap each other in an area of the secant intersection point.

10. The packaging for a strip of photosensitive material according to claim 3, characterized in that the peripheral areas comprise flap-shaped segments that are formed by short and long incisions starting on peripheries of the flexible sections, the long incisions terminating on a circle with a diameter smaller than an outer diameter of the cover sheet and in that the flap-shaped segments are adhered by the first adhesive layers to the cover sheet so that the flap-shaped segments lie on the outer axial edge portions of the cover sheet.

11. The packaging for a strip of photosensitive material according to claim 10, characterized in that each of the flap-shaped segments is formed by two different length incisions lying on secants that meet but do not cross over each other, whereby the flap-shaped segments, when curved down, overlap each other in an area of the secant intersection point.

12. The packaging for a strip of photosensitive material according to claim 2, characterized in that:

the sealing disks have outer edge portions; and the curved overhanging edge portions form lightproof labyrinths with the outer edge portions of the sealing disk, while the overhanging edge portions of the cover sheet curve fold-free onto the end faces and the outer edge portions of the sealing disks curve fold-free onto the outer axial edge portions of the cover sheet.

13. The packaging for a strip of photosensitive material according to claim 12, characterized in that the cover sheet is for forming a leader for the photosensitive material, tapers toward a starting end, and forms a flap-shaped starter piece that is asymmetrical.

14. The packaging for a strip of photosensitive material according to claim 2, characterized in that each of the flexible sections has perforations in the peripheral area.

15. The packaging for a strip of photosensitive material according to claim 14, characterized in that the perforations run along circles having a diameter that is smaller or equal to outer diameters of the sealing disks.

16. A process for enclosing in a lightproof manner a strip of photographic material that is wound as a roll having a width and end faces on a core having a passage and inner axial edge portions, comprising:

joining a first end of a cover sheet, which is wider than and slightly overhangs the roll, to an end of an outermost spiral of the roll;

winding the cover sheet around the roll and attaching a second end of the cover sheet to an outer circumferential surface of the cover sheet;

mounting hub-shaped sections in a friction fit manner in the passage;

adhering inner edge portions of flexible sections to the hub-shaped sections, the flexible sections having peripheral areas comprising flap-shaped segments that overhang the outer circumferential surface of the cover sheet; and curving the flap-shaped segments downward and applying a pressure incrementally on the flap-shaped segments towards outer axial edge portions of the outer circumferential surface of the cover sheet and in the direction toward the roll, such that the end faces come firmly together with sealing disks between the end faces and the flexible sections, and outer edge portions of the sealing disks form lightproof labyrinths with curved overhanging edge portions of the cover sheet, so that the cover sheet, the flexible sections, the sealing disks, the hub-shaped sections and the core enclose the photosensitive material in a lightproof manner.

* * * * *